United States Patent [19]

Hahn

[11] Patent Number: 4,601,158

[45] Date of Patent: Jul. 22, 1986

[54] CONTAINER FLAP FOLDING APPARATUS AND METHOD

[75] Inventor: Richard Hahn, Trenton, N.J.

[73] Assignee: Champale, Inc., Trenton, N.J.

[21] Appl. No.: 554,977

[22] Filed: Nov. 23, 1983

[51] Int. Cl.[4] ..... B65B 7/20

[52] U.S. Cl. ..... 53/491; 53/374

[58] Field of Search ..... 53/491, 467, 374, 375, 53/266 R, 382

[56] References Cited

U.S. PATENT DOCUMENTS

| | | | |
|---|---|---|---|
| 2,929,183 | 3/1960 | Magna | 53/374 |
| 3,032,947 | 5/1962 | Voller | 53/374 X |
| 3,146,566 | 9/1964 | Roth | 53/374 |
| 3,442,062 | 5/1969 | Lense | 53/374 |
| 3,703,067 | 11/1972 | Goodrich et al. | 53/374 |
| 3,905,175 | 9/1975 | Marchetti | 53/374 X |
| 3,977,162 | 8/1976 | Marchetti | 53/374 |

*Primary Examiner*—Horace M. Culver
*Attorney, Agent, or Firm*—Arthur A. March

[57] ABSTRACT

Container flap folding apparatus and method in which closable flap containers having outwardly and downwardly prefolded front and back end top flaps are conveyed along a path, a puller at a lower position in the path contacts an oncoming container front end below the outer free edge of its front flap and is displaced to an upper position above yet adjacent the container top portion to pull upwardly and urge relatively rearwardly and fold inwardly and downwardly such flap across the top portion, a pusher upstream of the puller and at a lower position out of the path is generally simultaneously displaced into the path to an upper position above yet adjacent the container top portion to push upwardly and forwardly the back flap to locate its outer free edge relatively forwardly of the container back end, a directing mechanism, including a forwardly downwardly inclined moving belt, cooperating with the pusher forwardly directs the so pushed back flap inwardly and downwardly to fold it across the top portion, and a control system automatically displaces the puller and pusher to their upper positions upon contact of the puller with the container and back to their lower positions, such as with a sensing switch arrangement to maintain the puller in its upper position until the container moves therepast before it returns to its lower position for contact with the front end of the next oncoming container.

12 Claims, 9 Drawing Figures

CONTAINER FLAP FOLDING APPARATUS AND METHOD

Figure 1:
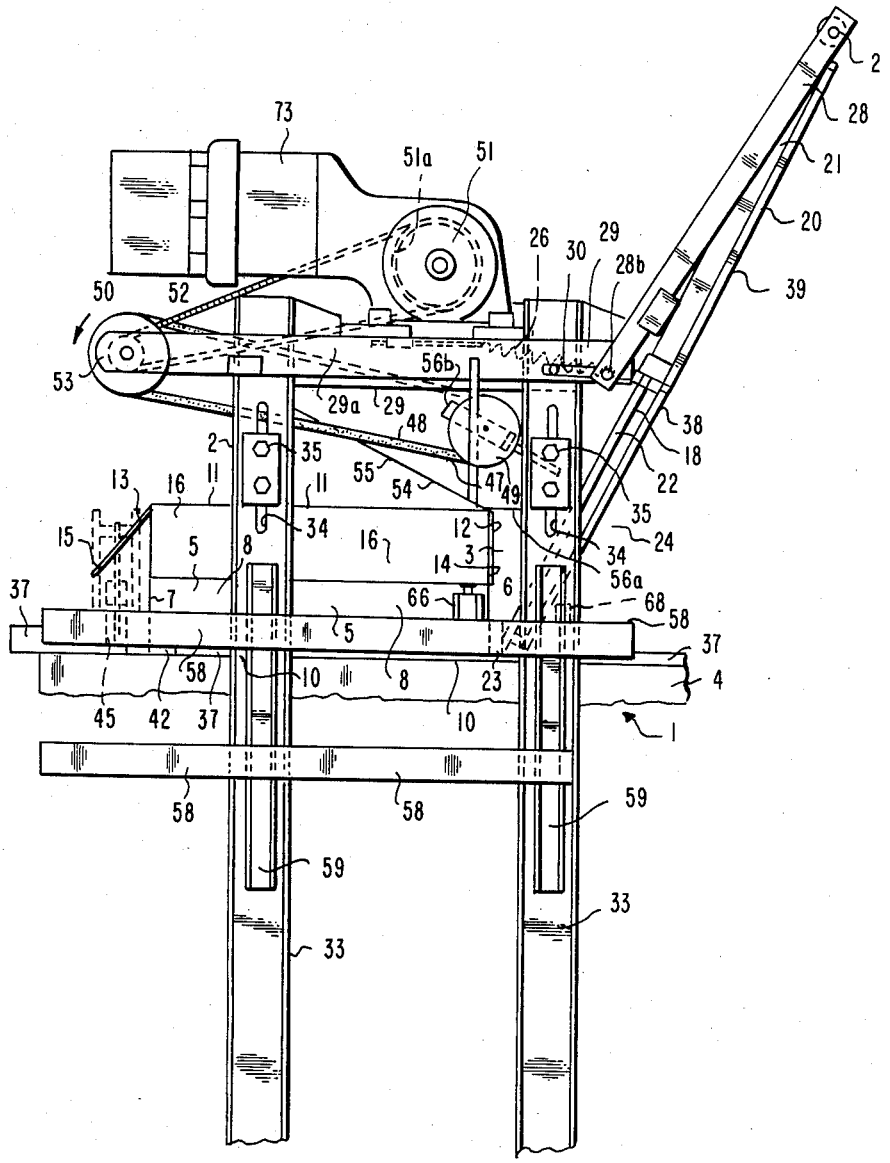

The present invention relates to a container flap folding apparatus and method, and more particularly to such an apparatus and method for automatically inwardly and downwardly folding the transverse front and back end top flaps of a container across the top portion thereof from an outward and downward position such as that at which the outer free edges of the flaps are located at an intermediate level between the container top and bottom portions, all during the continuous movement of the container along a conveyor path.

Various types of apparatus and conjoint methods are known for automatically folding transverse front and back, and longitudinal side, top and/or bottom container flaps so as to close containers such as cases, cartons, boxes and the like of cardboard, paperboard, corrugated board, etc., which have been usually prefilled with articles to be shipped therein such as beverage cans, spray cans, etc. Typical prior art in this regard includes the teachings in U.S. Pat. Nos. 4,249,978 (Baker); 4,196,563 (Gabrielson et al); 3,354,797 (Hickin); 3,808,770 (Berney); 3,543,469 (Ullman); 3,002,432 (Wendshuh); 3,302,367 (Talarico); and 2,929,183 (Magna).

However, such prior art suffers from various drawbacks and deficiencies, including expensive and complex arrangements and operations, the need for intermittent stoppages of the conveyor travel of the successive containers to permit one or more operations to be effected, and in regard to the infolding of front and back end top flaps, the limiting of the apparatus or method in relative terms of a horizontal conveyor path to use with flaps which are already vertically above the horizontal top portion or open end of the containers across which the flaps are to be folded during intermittent travel along the path, or to other restrictive factors which render such known apparatus and methods inefficient and costly or at best usable only with containers in which the flaps are specifically located and/or angularly oriented, yet always loosely disposed, relative to the containers and/or only in a multiple series of separate steps at relatively slow rate along an unduly long or longitudinally extended path arrangement for handling containers of a single unchangeable size.

For instance, U.S. Pat. No. 4,249,978 only concerns the infolding of the container side top flaps extending parallel to the conveyor path during movement along the path, by use of curved side guides which progressively flip the side flaps into folded position after adhesive material has been applied thereto for sealing them against the already infolded front and back end top flaps provided thereat by a prior operation using undisclosed means.

U.S. Pat. No. 4,196,563 similarly only concerns the end closing infolding of the container side top flaps extending parallel to the conveyor path during movement along the path, by use of transversely operating side tuckers.

U.S. Pat. No. 3,354,797 only concerns the analogous end closing infolding of the container side top and bottom flaps extending parallel to the conveyor path and their accompanying gussets during movement along the path, the container in this instance being in the form of a horizontal tubular blank positioned transversely on the coneyor.

U.S. Pat. No. 3,808,770 only concerns the counterpart upfolding of the container transverse front and back end bottom flaps in intermittent steps during stoppages of the container along the conveyor path, the container in this instance being in the form of a vertical tubular blank positioned upright on the conveyor, such that after the tubular blank has been lowered over the prearranged articles such as cans on a special support on the conveyor, the back bottom flap is forwardly folded by laterally spaced upwardly pivoting fingers from a downward vertical position upwardly to a horizontal position while the blank remains stationary, and upon again moving the blank along the path an angular stationary plate, disposed transversely across the path downstream of the pivoting fingers yet adjacent the special support, causes the front bottom flap to be rearwardly folded from a downward vertical position upwardly to a horizontal position as it moves over such plate, after which curved side guides progressively inwardly flip the side bottom flaps extending parallel to the path from a downward vertical position upwardly to a horizontal position, all while the articles remain in the tubular blank and the front and back end top flaps and side top flaps remain in upward vertical position.

U.S. Pat. No. 3,543,469 only concerns the end closing downfolding of the container transverse front and back end top flaps in intermittent steps during stoppages of the container along the conveyor path, such that an oncoming container front flap strikes the rear side of a downwardly extending wedge shaped front end of a reciprocating pivotal arm which downwardly bends the flap as the container moves forwardly against such rear side, then the arm is upwardly pivoted and rearwardly reciprocated to the back of the same container and again downwardly pivoted to lower the wedge shaped front end sufficiently to bend the back flap, and thereafter the arm is forwardly reciprocated to force the container forwardly against the next preceding and stopped container to assure complete bending of the front and back flaps to downward vertical position, whereupon the next successive oncoming container front flap strikes the rear side of the wedge shaped front end of the arm for repeating the cycle, a switching arrangement being provided to control the various intermittent operating steps.

U.S. Pat. No. 3,002,432 only concerns an arrangement which folds and automatically interlocks adjoining front corner edges of the precursor transverse front flap and parallel side flaps of a flat card provided with tongues and slits, but without any rear flap, to form an inward three sided lap over type holder for flatly packed material such as overlapping bacon slices, using a complex upwardly reciprocating recessed transverse plate to bend the front flap upwardly to right angle vertical position from the horizontally extending flat card and rearwardly against a downwardly displaced vertical transverse backing plate which travels forwardly along the conveyor path with the card, and then using a rearwardly facing spring urged telescopingly mounted cross rod to move against the upright bent front flap to hold it against the backing plate as the reciprocating plate returns to its recessed position and the card continues along the path, whereupon stationary curved guide rods fold the side flaps inwardly and downwardly along with the conjointly downwardly guided front flap and effect interlocking of the tongues and slits thereof.

U.S. Pat. No. 3,302,367 only concerns an arrangement which individually and successively folds the transverse front and back end top flaps of a container in timed automatic sequence when it is stopped intermittently along the conveyor path, and only where the flaps are already specifically angularly oriented, i.e. folded in raised upwardly bent outward position with the corresponding outer free edges thereof at a level above the top portion of the container, such that the front flap of the oncoming container hits a vertical gate which further upwardly bends the flap to vertical position and stops the container, then a downwardly moving angular pivotal finger pushes against the front flap of the stopped container, first bending it rearwardly and inwardly over the container top portion and finally flattening it horizontally, as the finger pivots from angular to horizontal position, whereupon the finger actuates a switch stopping further downward movment thereof, and thereafter the gate is released to permit the container to move below a cylinder operated pivotal tucker arm which bends the back flap further upwardly, and then forwardly and inwardly over the container top portion to horizontal position while the container is again stopped, after which the container is further moved to permit side guides to infold the side top flaps over the front and back end top flaps to complete the closure.

Lastly, U.S. Pat. No. 2,929,183 concerns an unduly long or longitudinally extended non-adjustable arrangement for individually and successively folding the transverse front and back end top flaps of a container of unchangeable size in a multiple series of separate steps at relatively slow inherent rate during movement along a conveyor path.

In a first step per said U.S. Pat. No. 2,929,183, a transverse idler rod slidable in forwardly upwardly inclined slots of nonadustable length and non-adjustable angle and extending longitudinally along the conveyor path in a pair of parallel vertical plates at the sides of the path, is contacted at the bottom of the slots by the front end of the oncoming container being pushed by endless conveyor lateral side chains along a stationery longitudinally extending support surface on which the prefilled deadweight container frictionally slides. The container front end contacts the rod at a lower level which is below the intermediate level between the container top and bottom portions at which the freely disposed outer free edge of the outwardly and downwardly prefolded transverse front flap is located. In turn, the rod is pushed by the container front end under inherent friction limiting slow rate operating conditions, i.e. both vertically upwardly along the container front end in frictional sliding contact therewith and forwardly upwardly along the inclined slots in opposing frictional sliding contact therewith, all while the prefilled container frictionally slides along the stationery support surface, to the top of the slots and to an upper level just above the container top portion. As the rod reaches the container top portion, it engages the underside of and rearwardly flips over the front flap to fold it temporarily horizontally inwardly across the container top portion until the flap clears the rod and again springs upwardly by itself. After the remainder of the container clears the rod, the latter merely slides by gravity back to the bottom of the slots.

In a second step per said U.S. Pat. No. 2,929,183, an electrically energized pivotal lever, of non-adjustable effective length and extending longitudinally along and in the path downstream of the rod, is resiliently temporarily pushed by the container transversely out of the path and, upon its return to the path behind the container, a switch is actuated by the container to energize temporarily the lever to pivot the lever from a lower level which is below the corresponding intermediate level between the container top and bottom portions at which the freely disposed outer free edge of the outwardly and downwardly prefolded transverse back flap is located, to an upper level just above the container top portion. As the free end of the lever reaches the container top portion, it engages the underside of and forwardly upwardly pushes the back flap to a raised level above the container top portion.

In a third step per said U.S. Pat. No. 2,929,183, an overlying and longitudinally extending pivotal finger, adjacent to and cooperating with the pivotal lever yet positioned out of the path at an upper level well above the upwardly sprung front flap, and periodically actuated by means not shown, is temporarily forwardly and downwardly pivoted into the path, after the front flap has moved therepast and out of its range, and in turn into finger folding contact with the raised level back flap. As the finger continues its movement, it folds the back flap closer inwardly over the container top portion, whereupon a centrally disposed overlying stationary guide having a forwardly downwardly inclined entrance portion slightly downstream of the lever and finger is positioned to receive and flatten across the container top portion the upwardly sprung front flap and in turn the closer inwardly folded back flap, apparently while the latter is still in contact with the finger, as the container moves under the stationary guide.

Clearly, these various prior art teachings do not contemplate means and steps which are adjustable for accommodating containers of different sizes and by which generally simultaneously the transverse front end top flap may be pulled effectively and the transverse back end top flap may be pushed effectively from corresponding outward and downward prefolded front and back end flap positions at which the corresponding outer free edges of the flaps are at a level intermediate the top and bottom portions of the container, in more or less completely automatic and affirmative, or positive mechanical, manner while the container is continously moving along the conveyor path, i.e. on the fly, under a control system lending itself to rapid rate and essentially trouble free coordinated step operation within a relatively short or longitudinally compact portion of the path.

It is among the objects and advantages of the present invention to overcome the various above noted drawbacks and deficiencies of the prior art, and to provide an improved container flap folding apparatus and method for adjustably accommodating containers of different sizes for generally automatically, and more or less substantially simultaneously, inwardly and downwardly folding the transverse front and back end top flaps of a given container across the top portion or top opening thereof from an outward and downward position such as that at which the outer free edges of the flaps are located at an intermediate level between the container top portion and bottom portion, and not merely located at a raised level above the container top portion, during the continuous movement of the container successively with like containers in spaced relation along a longitudinal conveyor path, i.e. while on the fly and without intermittent stoppages of the container to effect such folding.

It is among the additional objects and advantages of the present invention to provide such an apparatus and method in which the front flap folding may be readily effected even where the front flap is initially temporarily affixed or attached to the front end of the container, e.g. to conserve space between successive containers.

It is among the further objects and advantages of the present invention to provide an apparatus and method of the foregoing type using a control system lending itself to adjustable or selective rapid rate and essentially trouble free coordinated step operation within a relatively short or longitudinally compact portion of the conveyor path, and controlling the parts of the apparatus for reliably responsive actuation in an affirmative, or positive mechanical, manner.

It is among the still further objects and advantages of the present invention to provide an apparatus and method of the foregoing type which are of simple, inexpensive and efficient design, and which use readily available and low cost elements in a durable arrangement of long and reliable operating life, and with minimum chance of disruption or breakdown.

It is among the still further objects and advantages of the present invention to provide an apparatus of the foregoing type, usable for carrying out the foregoing conjoint type method, constituting a longitudinally compact, self-contained, preferably portable, flap folder unit or unitary composite structure, which may be adjusted to handle containers of different size, and which may be arranged as a temporary or permanent add-on assembly to an existing conveyor installation without the need to modify the existing installation.

Figure 2:
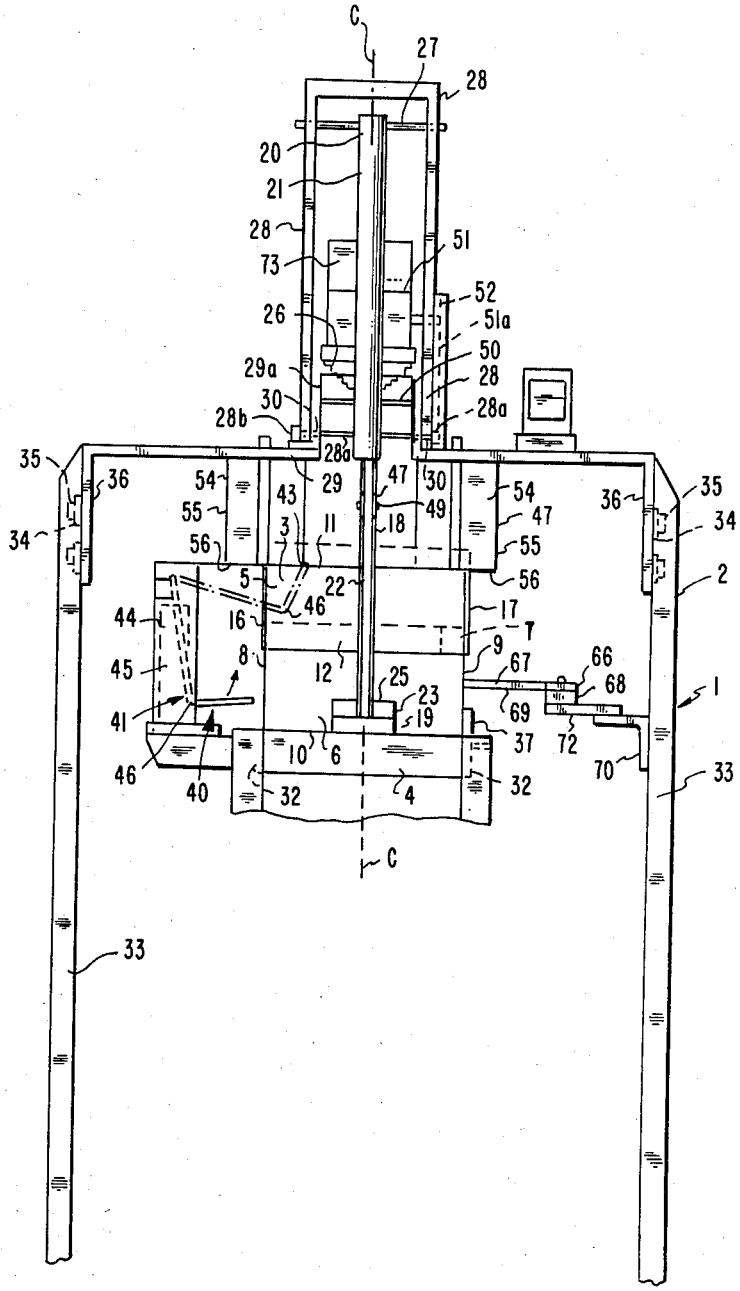
Figure 3:
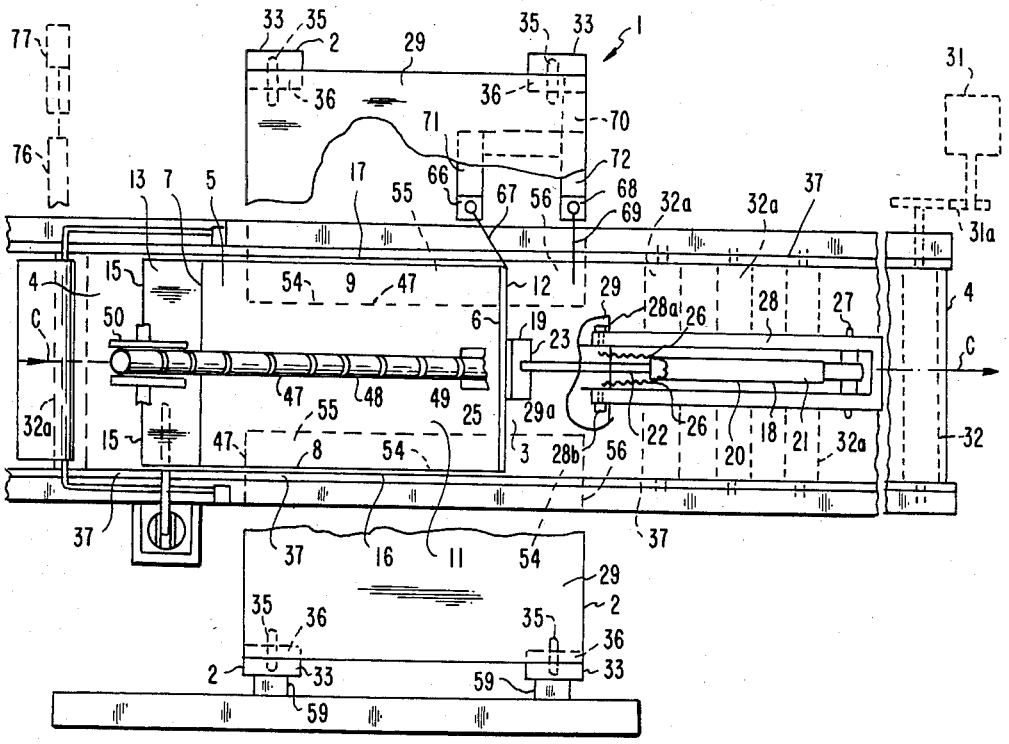
Figure 4A:
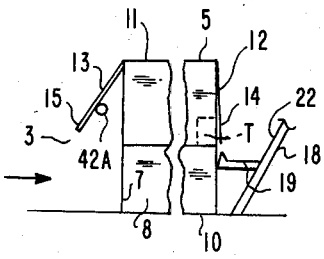
Figure 4B:
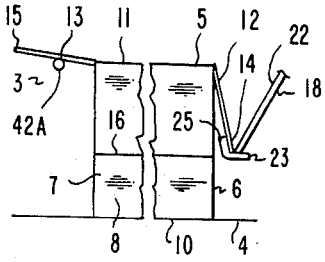
Figure 4C:
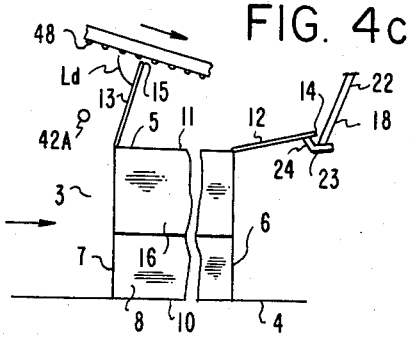
Figure 4D:
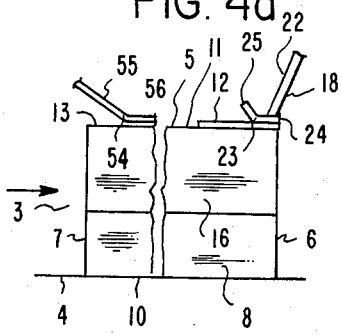
Figure 6:
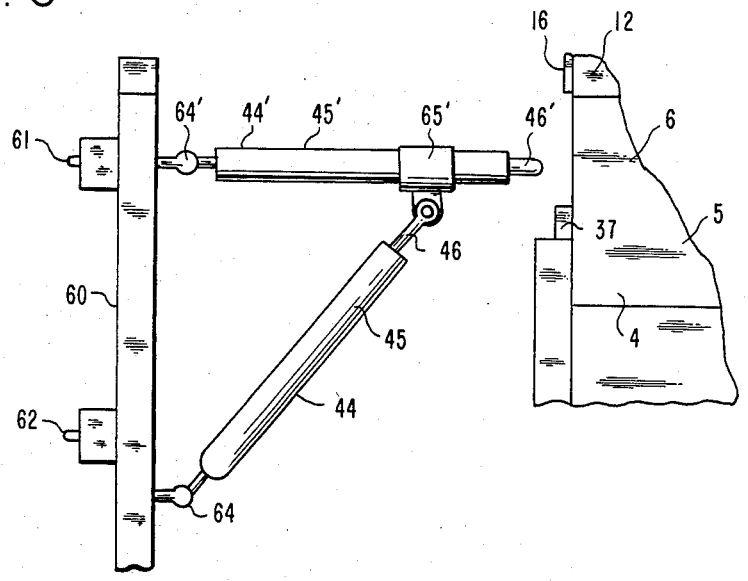
Figure 5:
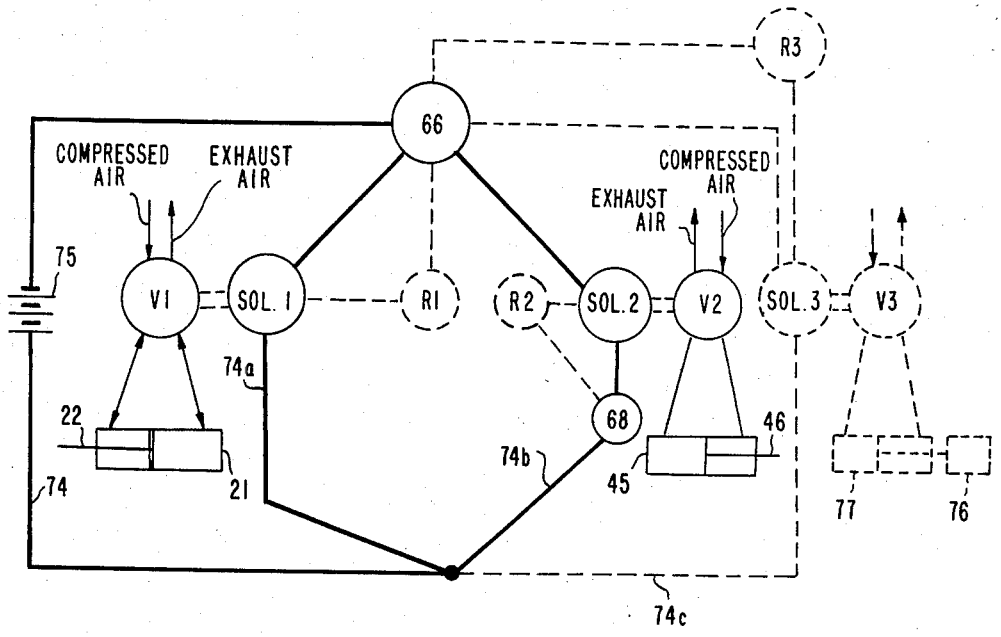

Other and further objects and advantages of the present invention will become apparent from a study of the within specification and accompanying drawings, in which:

FIG. 1 is a schematic side elevational view of the container flap folding apparatus according to one embodiment of the invention and in which the conjoint method may be correspondingly carried out, FIG. 2 is a schematic right end elevational view of the apparatus of FIG. 1, i.e. as seen from the front or downstream end thereof, FIG. 3 is a schematic top view of the apparatus of FIG. 1 with certain portions being omitted or shown in phantom to illustrate pertinent details, FIGS. 4*a* to 4*d* are schematic side views of progressive stages of the folding operation using the apparatus of FIG. 1, FIG. 5 is a schematic view of a typical control circuit arrangement for automatically controlling the operation of the apparatus of FIG. 1, and FIG. 6 is a schematic view of alternative embodiment of a portion of the apparatus of FIG. 1.

In accordance with a first main aspect of the present invention, a container flap folding apparatus is advantageously provided, which comprises means defining a longitudinal conveyor path, a front flap puller, a back flap pusher, back flap directing means and a control system.

The means defining the longitudinal conveyor path is arranged for accommodating a conveyor for moving along the path in forward direction closable flap containers of the type having relative to such path a transverse front end and a transverse back end as well as a bottom portion and a top portion and provided at the top portion with outwardly and downwardly prefolded corresponding transverse front and back end flaps terminating at outer free edges located, when at maximum outward and downward position, at a corresponding intermediate level between the top portion and bottom portion, such that the end flaps are arranged to be upwardly and inwardly folded across the top portion.

The front flap puller is normally positioned in the path at a lower position for contact with the front end of such a container below the maximum outward and downward position of the outer free edge of the outwardly and downwardly folded front flap thereof during the forward movement of the container, and is displaceable upwardly and forwardly to an upper position above yet adjacent the top portion of the container for pulling the front flap upwardly and for relatively urging the upwardly pulled front flap rearwardly to fold the flap inwardly and downwardly across the top portion of the container during the continued forward movement of the container.

The back flap pusher is disposed selectively upstream of the puller along the path and normally positioned out of the path at a lower position, and is displaceable into the path, and both upwardly from below the maximum outward and downward position of the outer free edge of the outwardly and downwardly folded back flap of the container into raising contact with such flap and relatively forwardly of the back end of the container, to an upper position above yet adjacent the top portion of the container for pushing the back flap upwardly and forwardly for locating the outer free edge thereof relatively at least slightly forwardly of the back end of the container during the continued forward movement of the container.

The back flap directing means cooperate with the pusher and are arranged adjacent the upper position of the pusher for forwardly directing the upwardly and forwardly pushed back flap inwardly and downwardly to fold the flap across the top portion during the continued forward movement of the container.

The control system is provided for correspondingly displacing the puller and pusher from their lower positions to their upper positions upon contact of the puller with the container.

Preferably, the control system includes container sensing means for maintaining the puller in its upper position until the back end of the container has moved therepast.

More particularly, a conveyor is desirably arranged for moving the containers along the path, and the back flap directing means may include a forwardly downwardly inclined endless moving belt arranged for engaging the back flap in the forward direction along the path at a moving speed exceeding that of the conveyor for further pushing the back flap inwardly and downwardly across the top portion, and stationery pressing guide means in positional association therewith for receiving the further inwardly and downwardly pushed back flap and guidingly pressing such flap across the top portion of the container during the continued forward movement of the container.

The puller and pusher are favorably each displaced between their upper and lower positions by a corresponding piston-cylinder arrangement, e.g. of the air energized double acting type.

Preferably, the puller is provided with a prying edge sufficient for engaging the outer free edge of the front flap of the container when the front flap is initially temporarily attached or affixed to the front end of the container, for prying loose such front flap therefrom upon displacement of the puller to its upper position.

The control system may include a control circuit having a normally open first limit switch arranged in the path longitudinally adjacent the puller lower position for continuous contact with the corresponding container throughout its movement therepast for closing such switch for controlling the displacing of the puller and pusher to their respective upper positions and for controlling the maintaining of the puller in its upper position until the container has moved therepast and the first switch reopens for in turn controlling the displacing of the puller back to its lower position, and also having a normally closed second limit switch arranged in the path downstream of the first switch a selective distance sufficient for the meanwhile displacing by the first switch of the pusher to its upper position before the container reaches the second switch, the second switch being arranged for contact with the container for opening such second switch for controlling the displacing of the pusher back to its lower position before the entire container has moved past the first switch.

Thus, for instance where the puller and pusher are each displaced between their lower and upper positions by a corresponding piston-cylinder arrangement, e.g. pneumatically operated via a solenoid actuated control valve, the control circuit may favorably include a puller solenoid controlled by the first switch for operating the piston-cylinder arrangement for the puller during the entire time the container is in contact with the first switch, and correspondingly may also include a pusher solenoid initially controlled by the first switch for operating the piston-cylinder arrangement for the pusher upon contact of the container with the first switch and thereafter controlled by the second switch upon contact of the container therewith, and during the time the container is still in contact with the first switch, for subsequently operating the piston-cylinder arrangement for the pusher, i.e. solely by the second switch.

Desirably, relay means may also be provided in the control circuit for appropriate continued electric energizing control of the solenoids in conjunction with the container actuation and deactuation of the corresponding switches, to assure not only forward or upward positive displacement of the respective puller piston rod and pusher piston rod in more or less simultaneous manner upon closing the first switch, but also return or downward positive displacement of the pusher piston rod upon opening the second switch followed by return or downward positive displacement of the puller piston rod upon reopening the first switch and prior to reclosing the second switch.

Advantageously, the puller is desirably longitudinally resiliently mounted relative to the path for resilient travel a selective distance in the forward direction upon contact with the front end of the container and during the continued forward movement thereof when the puller is in its lower position for enhancing the contact between the puller and the container, and for return travel a corresponding distance in the rearward direction upon displacement of the puller to its upper position for enhancing the urging of the front flap rearwardly during the folding of the flap inwardly and downwardly acoss the top portion of the container.

Conveniently, a conveyor is arranged for moving the containers, e.g. successively and in spaced relation, along the path, and the conveyor is disposed for continuously moving the containers along the path at a selective substantially constant yet adjustable speed.

In accordance with a second main aspect of the present invention, a method for folding container flaps is advantageously provided, which comprises moving automatically along a longitudinal path in forward direction successive spaced apart closable flap containers of the type having relative to such path a transverse front end and a transverse back end as well as a bottom portion and a top portion and provided at the top portion with outwardly and downwardly prefolded corresponding transverse front and back end flaps terminating at outer free edges located at a corresponding intermediate level between the top portion and bottom portion, such that the end flaps are arranged to be upwardly and inwardly folded across the top portion, in conjunction with the maintaining and displacing of a front flap puller and a back flap pusher and associated steps to achieve the automatic folding of such flaps, all during the continuous movement of each such container along the path, i.e. while on the fly and without intermittent stoppage of the container to effect such folding.

More particularly, the process includes maintaining a front flap puller normally positioned in the path at a lower position for contact with the front end of an oncoming such container below the outer free edge of the outwardly and downwardly folded front flap thereof during the forward movement of the container, and upon such contact automatically displacing the puller upwardly and forwardly to an upper position above yet adjacent the top portion of the container for pulling the front flap upwardly and for relatively urging the upwardly pulled front flap rearwardly to fold the flap inwardly and downwardly across the top portion during the continued forward movement of the container.

In turn, the process likewise includes maintaining a back flap pusher selectively upstream of the puller along the path and normally positioned out of the path at a lower position, and at substantially about the same time that the container contacts the puller also automatically displacing the pusher into the path, and both upwardly from below the outer free edge of the outwardly and downwardly folded back flap of the container into raising contact with such flap and relatively forwardly of the back end of the container, to an upper position above yet adjacent the top portion of the container for pushing the back flap upwardly and forwardly for locating the outer free edge thereof relatively at least slightly forwardly of the back end of the container during the continued forward movement of the container, and thereafter returning the pusher to its lower position.

Additionally, the process further includes automatically forwardly directing the upwardly and forwardly pushed back flap inwardly and downwardly to fold the flap across the top portion of the container during the continued forward movement of the container, and automatically maintaining the puller in its upper position until the entire container moves therepast, and thereafter returning the puller to its lower position for contact with the front end of the next oncoming such container.

Conveniently, the containers are desirably continuously moved automatically along the path at a selective substantially constant yet adjustable speed, i.e. during all such steps.

In accordance with a preferred feature of the present invention, the front flap of the corresponding container may be initially temporarily attached or affixed, e.g. via a rupturable tab or adhesive material, to the front end thereof, and the puller is provided with a prying edge sufficient for engaging the outer free edge of the front flap for prying loose such front flap therefrom upon displacement of the puller to its upper position, and such displacement is automatically carried out to effect such prying loose of the front flap.

Referring to the drawing, and initially FIGS. 1–3, a container flap folding apparatus 1 is shown which is usable for carrying out the folding of container flaps according to the method of the present invention, including means such as the longitudinally compact framework or path support 2 which defines a longitudinal conveyor path 3 arranged for accommodating a conveyor 4, e.g. having a moving conveyor surface of the endless belt type, for moving along the path 3 in forward direction, as in the direction from left to right as indicated by the arrows in FIGS. 1 and 3, closable flap containers 5, one of which is shown and which are desirably already filled with the articles to be contained therein.

Container 5 is of the type generally having relative to the path 3 a front end or transverse vertical wall 6, a back end or transverse vertical wall 7, lateral sides or longitudinal vertical walls 8 and 9, a normally closed botton portion or horizontal end 10, and a top portion or horizontal end 11 which defines a top opening, and provided at the open top portion 11 with outwardly and downwardly prefolded corresponding transverse front and back end top flaps 12 and 13 terminating at outer free edges 14 and 15 located, when at maximum outward and downward position, at a corresponding intermediate level vertically between the top portion 11 and the bottom portion 10, such that the end flaps 12 and 13 are arranged to be upwardly and inwardly folded across the top portion 11 (see FIGS. 4*a* to 4*d*).

Container 5 normally also has corresponding longitudinal side top flaps 16 and 17, which may be prefolded outwardly and downwardly as well, as where these flaps are to be infolded in a later operation in conventional manner after the front and back end flaps 12 and 13 have be folded across the top portion 11 according to the present invention, whereby to provide an article filled and finally closed container.

A front flap puller 18 is normally adjustably positioned in the path 3 at a lower position 19, e.g. at a level below the intermediate level of the outer free edge 14 of the front flap 12, such as in resting slidable disposition on the conveyor 4 or preferably slightly thereabove to provide working clearance therebetween, for contact with the container front end 6. Such lower position 19 is in any case below the maximum outward and downward position of the front flap outer free edge 14 so as to achieve unhindered contact of the puller 18 with the container front end 6 during container forward movement for operative action thereafter on the overlying front flap 12.

For this purpose, the puller 18 is desirably provided as a double acting piston-cylinder arrangement 20, disposed angularly upwardly in the forward direction of the path 3 and which includes a cylinder 21 and piston rod 22, preferably of the pneumatic or compressed air energized type, and which also contains the puller element 23 at the free end of the rod 22 and which is normally located at the lower puller position 19.

Hence, upon contact with the front end 6 of the container 5, the puller 18 is displaced upwardly and forwardly to an upper position 24 (see FIGS. 4*c* and 4*d*) above yet adjacent the container top portion 11. This serves to pull the front flap 12 upwardly and in turn to urge relatively the upwardly pulled front flap rearwardly to fold it inwardly and downwardly across the top portion 11 during the continued forward movement of the container 5, as shown in the sequences of FIGS. 4*a* to 4*d*.

It will be seen that puller element 23 is suitably provided with an upwardly bent prying edge 25 sufficient for engaging the outer free edge 14 of the front flap 12 when the front flap is temporarily attached or affixed to the container front end 6 as by adhesive material or a rupturable attachment tab T (shown in phantom in FIGS. 2 and 4*a*), so as to pry loose thereby the front flap 2 fron the front end 6 upon displacement of the puller 18 to its upper position 24 via actuation of the piston-cylinder arrangement 20.

Favorably, springs 26 (FIGS. 1 and 3) or the like, or any other suitable resilient means, may be provided for longitudinally resiliently mounting the puller 18 relative to the path 3, for resilient travel a selective distance in the forward direction upon contact with the container front end 6 and during the continued forward movement of the container 5 when the puller is in its lower position 19, for enhancing the contact between the puller and the container, and for return travel a corresponding distance in the rearward direction upon displacement of the puller 18 to its upper position 24, for enhancing the urging of the front flap 12 rearwardly during the folding of the flap inwardly and downwardly across the top portion 11 of the container 5 (see FIGS. 1, 3 and 4*a* to 4*d*).

In this regard, the piston-cylinder arrangement 20 of the puller 18 is suitably pivotably mounted via pivot pin 27 in the angle frame 28 which is adjustably rigidly fixed to the raised bridge section 29 of the support 2.

The conveyor 4 is generally arranged for moving the containers 5 along the path 3 continuously and at a selective substantially constant yet adjustable speed, as by a suitable motor 31 which is disposed with gearing 31*a* for driving a drive roll 32 at the forward end of the conveyor (as shown in phantom in FIG. 3), with the containers 5 riding via the surface of the belt of the conveyor 4 over the equidistantly spaced idler rolls 32*a* thereof in conventional manner (some of which are shown in phantom in FIG. 3).

Naturally, the constant speed of movement of the conveyor 4 may be independently variably adjusted or selected in conventional manner, e.g. by corresponding adjustment or selection of the gearing 31*a* of the motor 31, to accommodate different size containers and/or the speed of displacing movement of the puller 18 and of the hereinafter described pusher 40.

Thus, as the oncoming container 5 strikes the puller 18 in its lower position 19 and continues to move in forward direction, its mass, especially as aided by the weight of the articles such as beverage cans with which it has been preferably prefilled, and its friction condition with the moving surface of the conveyor 4, are sufficient to place the puller 18 under tension, e.g. stretching the springs 26 and causing the cylinder 21 to pivot about pin 27 in forward or counterclockwise direction (as viewed in FIG. 1).

This insures that the prying edge 25 of the puller element 23 will remain in tension contact with the container front end 6, and that upon inward displacement of the piston rod 22 into the cylinder 21, such tension contact will facilitate the prying action of the prying edge 25 upwardly against the overlying outer free edge 14 of the front flap 12, especially where such flap is temporarily, i.e. pryably loosenably, attached or affixed to the container 5, as by the tab T (FIGS. 2 and 4*a*).

It will be appreciated in this regard that such longitudinal resilient mounting of the puller 18 facilitates adjustment of the positional relation between the container 5 and the puller 18 during the various sequential operations in upwardly and inwardly folding the front flap 12, i.e. horizontally, across the top portion 11.

Conveniently, the horizontal or longitudinal forward speed of the conveyor 4 and the inclined longitudinal forward and upward speed of the puller 18 from its lower position 19 to its upper position 24, upon energizing the piston cylinder arrangement 20, will be matched or coordinated in conjunction with the timing of the initiating of such energizing, so that the puller element 23 will remain throughout its movement in contact first with the container front end 6, then with its front flap outer free edge 14 and/or underside as the case may be, and finally with such underside, eventually flipping over the front flap 12 to change such underside to a top surface against which the underside of the puller element 23 resiliently presses to iron the front flap 12 as the latter continues to move in forward direction.

Prior to flipping over the front flap 12, depending upon the angular attitude of the front flap 12 and the piston rod 22, the piston rod itself may also engage, under the resilient tension of springs 26, the front flap outer free edge 14 as well as the underside of the front flap, although at most to a much less extent that the engagement of the puller element 23 with such flap edge and flap underside, yet such piston rod engagement will contribute supplemental positive pulling and lifting action to the main pulling and lifting action which is positively or affirmatively exerted mechanically on the front flap by the puller element 23 under the energized displacing force of the piston-cylinder arrangement 20.

By maintaining the puller element 23 slightly raised above the surface of the conveyor 4 in the lower position 19 of the puller 18, upon contact with the front end 6 of the container 5 the puller 18 will rotate about pivot pin 27 slightly forwardly and downwardly relative to the surface of the conveyor 4 yet the puller element 23 will have sufficient room to move in corresponding direction without jamming against the conveyor 4 prior to the initiation of the displacing of the puller 18 to its upper position 24.

However, by using a pneumatically operated piston-cylinder arrangement, which is energized by compressed air or other gas as inherently compressible gaseous fluid, as distinguished from using a hydraulically operated piston-cylinder arrangement, which is energized by oil or other liquid as inherently incompressible liquid fluid, the gas itself in the cylinder acts against the end of the piston rod enclosed within the cylinder.

The springs 26 may be replaced by a similar pneumatically operated piston-cylinder arrangement, i.e. in the form of a sealed gas containing cylinder against which its piston rod may act, or by any other suitable means (not shown), so as to constitute a resilient shock absorber arrangement, e.g. between the bridge section 29 and the cylinder 21, for enabling the puller 18 to be moved forwardly, i.e. in counter-clockwise direction, and thence rearwardly, i.e. in clockwise direction, about the pivot pin 27, as shown in FIG. 1, for resilient forward travel relative to the path 3 upon contact with the oncoming container 5 at its lower position 19 and during displacement to its upper position 24, and thereafter for resilient rearward return travel relative to the path 3 upon reaching its upper position 24.

Clearly, the longitudinally resilient mounting of the puller 18, according to this preferred feature, will avoid any disruption which might otherwise occur as the puller starts its movement to the upper position 24. This is because the resiliently absorbed tension exerted against the puller element 23 by the container front end 6 will keep the prying edge 25 in proper positional alignment with the front flap outer free edge 14 before, during and after initial pulling and prying contact therewith, throughout the dual forward conjoint relative movement of the front flap 6 and puller 18, and despite any abrupt interim change in relative or resultant force and direction as where the front flap 12 is temporarily attached or affixed to the container front end 6 and the prying edge 25 is used to pry loose or detach the front flap 12 from such front end and then raise the flap as the puller 18 moves from its lower position 19 to its upper position 24, all during the continued forward movement of the container 5 along the path 3.

Likewise, once the puller 18 reaches its upper position 24, the resiliently absorbed tension will enhance the bending and urging of the front flap 12 rearwardly for inwardly and downwardly folding such flap, i.e. horizontally, across the top portion 11. This is because the puller 18 is above yet adjacent the top portion 11 at this point and no longer moving in forward direction nor subject to the forward force of the container 5. Hence, the absorbed tension will be released so as to move the puller element 23 in rearward or reverse direction at an actual travel rate relative to the path 3 and support 2, and at the same time at a faster differential travel rate relative to the front flap 12, container 5 and conveyor 4, since the latter continue to move in forward direction throughout.

In this way, the automatic folding of the front flap is effectively carried out while the container is continuously moving along the path, i.e. on the fly, and the positional relationship between and relative movement of the puller 18 and front flap 12 are conveniently matched or coordinated, with any minor deviations therebetween being offset and compensated for by the provision for longitudinally resiliently mounting the puller 18 relative to the path 3, i.e. mounting the puller 18 for resilient operative movement longitudinally forwardly and thence rearwardly in the longitudinal direction of the path 3.

Naturally, the speed of displacing movement of the piston rod 22 may be independently variably adjusted or selected in conventional manner, e.g. by corresponding adjustment or selection of the energizing air pressure, to accommodate different size containers and/or the speed of movement of the conveyor 4.

As will be appreciated, the fixed or inner end of the angle frame 28 on the raised bridge section 29 of the support 2 may be selectively longitudinally pivotally operatively mounted as a bifurcated end via a pair of elongated slots 30 extending horizontally in parallel vertical planes in the longitudinal direction of the path 3 in the corresponding bifurcated lower end of an upright vertical portion 29a of the bridge section 29, by means of a horizontal transverse bolt 28a extending through the bifurcated end of the angle frame 28 thereat and forming a horizontal transverse pivot therefor, plus a tightening nut 28b, or by any other suitable means (not shown), for adjustably rigidly fixing the angle frame 28, i.e. about the axis of the horizontal transverse bolt 28a, at any selective angle relative to the horizontal surface of the conveyor 4 and, i.e. at a given longitudinal point along the slots 30 in the upright vertical portion 29a of the bridge section 29, at any selective longitudinal point relative to the path 3.

Thus, such nut 28b may merely be tightened on the end of the bolt 28a to fix the angle frame 28 to the upright vertical portion 29a of the bridge section 29 in a rigid yet selectively adjustable manner at any longitudinal point along the slots 30 and at any appropriate angle of the angle frame 28 to the surface of the conveyor 4.

Moreover, the bridge section 29 is itself preferably vertically adjustably mounted on the four legs of the base section 33 of the support 2, e.g. in conventional manner via a corresponding set of four recessed elongated slots 34 extending vertically in respective vertical planes in the upright legs of the base section 33 by means of conjoint threaded bolts 35, in this case engaging with threaded bores in the downwardly depending integral bracing flanges 36 of the bridge section 29 (FIGS. 1 and 2).

In addition, if desired, the length of the angle frame 28 may be adjusted by making the same of overlapping or telescoping subparts which may be reduced or extended in overall length, e.g. by conventional bolt and elongated slot, or set screw, connecting means or the like (not shown).

Such various independent selective adjustment means of generally individually conventional design will thus permit the pivot pin 27 to be positioned at any selective point in space normal to a vertical longitudinal plane extending along the path 3, for adjustment in turn as desired of the inclined angle of the piston-cylinder arrangement 20 with the horizontal surface of conveyor 4, of the corresponding disposition of the puller element 23 relative to any given longitudinal point along the path 3, and of the height or level of the puller element 23 above the surface of the conveyor 4, both in terms of the selective lower position 19 and the selective upper position 24, whereby to accommodate any given size container 5, as regards its vertical height and the length of its front flap 12 between its top portion 11 and its outer free edge 14.

Of course, as will be apparent, the transverse width of of the container 5 is not critical in connection with the folding of its front and back end flaps 12 and 13. Thus, the usual lateral or side guides 37, extending longitudinally along and outwardly of the path 3 for maintaining the containers 5 in central or centered and aligned position during movement along the path, may be provided as outwardly and inwardly transversely adjustable guides in the conventional manner for accommodating containers 5 of any given transverse width travelling on the surface of the endless belt of the conveyor 4.

In order to assure that the puller element 23 and especially the prying edge 25 will remain in proper horizontal non-rotating position in any position of rest or actuation of the piston rod 22 within the cylinder 21, a separate slide rod 38 reciprocating in a slide bore cylinder 39 rigidly fixed to the underside of the cylinder 21 may be provided, such that the free end of the slide rod 38 will be displaced as a slave element simultaneously with the displacing of the piston rod 22 and in the same direction therewith. This will keep the puller element 23 and its prying edge 25 from rotating, since the fixed disposition of the slide bore cylinder 39 relative to the cylinder 21 will prevent rotation of the piston rod 22 relative to the cylinder 21.

The same effect, of course, can also be attained by changing the cross section of the cylinder 21 and of the piston of the piston rod 22 captively enclosed within the hexagon cylinder 21 in the well known manner, so that the piston rod 22, and in turn the puller element 23, will not rotate about the piston rod axis relative to the non-rotatably mounted cylinder 21.

In conjunction with the foregoing, a back flap pusher 40 is adjustably disposed selectively upstream of the puller 18 along the path, e.g. approximately a longitudinal distance equal to the longitudinal length of the containers 5 being handled in the operation. The pusher 40 is normally positioned out of the path 3 at a lower position 41, i.e. adjacent one lateral side of the conveyor. As shown, the pusher comprises a rod 42 having an integral offset arm 42A.

Such lower position 41 is in any case below the maximum outward and downward position of the outer free edge 15 of the freely disposed back flap 13. Normally, unlike the optional, yet preferred, affixing of the front flap 12, e.g. to conserve space between successive containers 5 moving on the conveyor 4, the back flap 13 will not be temporarily attached or affixed to the back end 7 of the container 5, but rather will be freely or loosely disposed in random slightly elevated position at a small angle to the vertical back end 7.

Nevertheless, the pusher or lifter 40 is arranged for movement into the path 3, and both upwardly from a level below the maximum outward and downward position of the back flap outer free edge 15 of the outwardly and downwardly folded back flap 13 into raising contact with the underside of such flap and relatively forwardly of the back end 7, to an upper position 43 above yet adjacent the top portion 11 of the container 5 for pushing the back flap 13 upwardly and forwardly for locating its outer free edge 15 relatively at least slightly forwardly of the container back end 7. This movement continues during forward movement of the container along the path 3, i.e. while on the fly, as shown in the sequences of FIGS. 4a to 4c.

For this purpose, the pusher 40 is desirably provided as a double acting piston-cylinder arrangement 44, which causes the pusher 40 to become extended as shown in dotted lines in FIG. 2 when the cylinder is moved downwardly.

The pusher or lifter 40 comprises a piston-pivotable arm arrangement 44 and includes a cylinder 45 and a pivotable rod 46. The piston is preferably of the pneumatic or compressed air energized type, like those of the piston-cylinder arrangement 20 for the puller 18. In this instance, however, the pivotable rod is spaced from the cylinder 45. The cylinder is activated to cause the spaced pivotable rod secured thereto to move from its downward position shown in FIG. 2 to move upwardly, and engage the underside of the back flap 13 and push the same upwardly and forwardly of the back 7, all during the continued forward movement of the container 5 along the path 3, once the piston pivotable rod arrangement has been activated. As a consequence, a positive movement engaging virtually the complete underside of the back flap 13 is provided causing the back flap to obtain the desired position as the packaging process proceeds.

Unlike the action of the puller 18 which moves ahead of the front flap 12 in the forward direction as it is displaced from its lower position 19 to its upper position 24, the pusher or lifter 40 moves behind the back flap 14 in the forward direction as it is displaced from its lower position 41 to its upper position 43, yet before completing its displacement must adequately bend the back flap 13 forwardly beyond the back end 7 of the container 5 for efficient further folding of the back flap 13, i.e. by the separate back flap directing means 47 which cooperate with the pusher 40 thereat.

In this regard, the speed of displacing movement of the pivotable rod 46 may likewise be independently variably adjusted or selected in conventional manner, e.g. by corresponding adjustment or selection of the energizing air pressure, to accomodate different size containers and/or the speed of movement of the conveyor 4. The speed of movement of pivotable rod 46 may be the same as or different from that of the piston rod 22, as desired, yet will generally exceed that of the conveyor 4 since it must move the back flap upwardly and forwardly at a faster rate than the container 5 is moving.

The back flap directing means 47 are advantageously arranged on the bridge section 29 adjustably adjacent the upper position 43 of the pusher 40 for forwardly directing the upwardly and forwardly pushed back flap 13 inwardly and downwardly to fold the flap across the container top portion 11 during the continued forward movement of the container 5 along the path 3. Thus, desirably such directing means 47 include a forwardly downwardly inclined endless moving belt 48 adjustably selectively arranged for engaging the back flap 13 in the forward direction along the path 3 at a moving speed exceeding that of the conveyor 4 for further pushing the back flap 13 inwardly and downwardly across the container top portion 11.

The belt 48 is suitably mounted on a pair of front and back pulleys 49 and 50 suitably carried by the bridge section 29 and driven by a motor 51 and associated gearing **51*a* through a drive chain coupling 52 or the like operatively connected to the back pulley 50 as shown in FIGS. 1 and 2. The belt speed may also be independently variably adjusted or selected in conventional manner, e.g. by corresponding adjustment or selection of the gearing 51*a* of the motor 51, to accommodate the speed of the conveyor 4**.

In order to accommodate the upper run of the belt 48 and the back pulley 50 which is at a higher level than that at which the front pulley 49 is disposed, these parts as well as the motor 51 and associated gearing **51*a* and the drive chain coupling 52 are appropriately arranged on the upright vertical portion 29*a* of the bridge section 29, i.e. rearwardly of the angle frame 28. Upright vertical portion 29*a* is suitably arranged as an inverted U-shaped central upright vertical portion laterally outwardly connected to the remainder of the bridge section 29 and has a rearwardly extending back puller bracket 53 (FIG. 1**).

Hence, a generally unobstructed free space is provided in the rearward area within the inverted U-shaped portion **29*a* for housing the upper run of the belt 48 and on top of which portion 29*a* the motor 51 is located. On the other hand, the rearwardly extending bracket 53 is clear of the remainder of the structure of the bridge section 29 and suitably operatively supports the back pulley 50 and the adjacent portion of the drive chain coupling 52 as well as the belt 48** in unhindered manner.

The front pulley 49 is suitably attached to the bridge section 29 so as to depend therebelow and thus supports the belt 48 in an unhindered manner also.

In operative conjunction with the moving belt 48, the back flap directing means 47 also preferably include stationary pressing guides 54 for receiving the further inwardly and downwardly pushed back flap 13 and in turn guidingly pressing such flap across the container top portion 11 during the continued forward movement of the container 5. These guides 54 are arranged at the underside of the bridge section 29 in laterally spaced apart or parallel relation and have a rear angular portion 55 which is forwardly downwardly inclined in the longitudinal direction of the path 3, and a front horizontally flat plate extension portion 56, as shown in FIGS. 1 and 2 and, for clarity of other parts, only shown in phantom in FIG. 3.

The rear angular portion 55 of each guide 54 is disposed at a level above the upper position 43 of the pusher 40 and slightly forwardly thereof in the direction of the path 3, and its rear area is above the uppermost reach of the back flap outer free edge 15 when the back flap 13 is flipped by the pusher 40 to its vertical position and thence angularly forwardly of the container back end 7, whereas its forward area is progressively forwardly and downwardly inclined to a level adjacent yet above the container top portion 11 and corresponding to the level of the puller 18, and more specifically of the puller element 23, when at its upper position 24.

The front flat plate extention portion 56 of each guide 54 forms a relatively thin plate thickness free end continuation of the corresponding rear angular portion 55 and extends horizontally at such level adjacent yet above the container top portion 11 and terminates at a forwardly facing front free end area which is located below the bridge section 29 sufficiently to form a clear and open deadspace between its top surface and the corresponding underside of the bridge section 29, i.e. forwardly of the front pulley 49, as shown in FIG. 2.

Moreover, due to the lateral spacing between the two guides 54, a central open space is provided therebetween, not only to accommodate the upper and lower runs of the moving belt 48 and the front pulley 49, but also to permit unhindered movement of the longitudinally resiliently movable puller 18, and more specifically of the piston rod 22 and puller element 23, in the vicinity of the forwardly facing front free end area of the two flat plate extension portions 56 thereat, as shown in FIGS. 1 to 3.

Of course, the back flap directing means 47 may be selectively vertically adjusted in height relative to the path 3 and the horizontal surface of the conveyor 4 by vertical adjustment of the bridge section 29, and in turn of its upright portion **29*a* and bracket 53, relative to the base section 33 in the previously described manner, whereby to adjust the back flap directing means 47 to accomodate any appropriate size containers 5 being handled thereby in conjunction with the adjustment of the puller 18, and more specifically of the angle frame 28 and pivot pin 27**.

On the other hand, the pusher 40 may be independently adjusted as to its angular crosswise attitude relative to the path 3, as to its position longitudinally upstream of the puller 18 along the path 3, and as to the level of its lower position 41, by any appropriate mounting arrangement 57 for likewise accommodation of any appropriate size containers 5.

For instance, mounting arrangement 57 may include a pair of parallel horizontal bars 58 horizontally adjustably mounted (by means not shown) on a pair of parallel vertical track members 59 in turn vertically adjustably mounted (by means not shown) on the legs on the lateral side of the base section 33 at which the pusher 40 is located, plus an angle bracket 60 pivotally carried at the upstream end portions of the horizontal bars 58 via upper and lower pivot pins 61 and 62.

Thus, by moving the bars 58 horizontally in the same direction the position of the bracket 60 may be shifted to a selective longitudinal point along the path 3, and by relatively moving the bars 58 horizontally in opposite directions to rotate the bracket 60 via its pivot pins 61 and 62, the bracket angle relative to the vertical may be changed selectively. Of course, the bars 58 and members 59 are so releasably fixedly arranged that they may be readily released for unhindered corresponding horizontal, vertical and especially angular adjustment of the bracket 60 as the case may be, and then retigthened, in conventional manner.

The arrangement for lifting and maintaining the position of the back flap so that its outer free edge 15 is at least slightly forward of the back end 7 for proper engagement of the overlying lower run of the belt 48, as shown in the sequences 4*a* to 4*c*, is accomplished by a unique and novel arrangement, including a cylinder 45 activating a pivotable rod 46 in timed sequence as the package moves forward. To insure that the outer free edge 15 will be at least slightly forward of the back end 7 of the container 5 at the point of contact, the arrangement is such that the rod on the cylinder is pulled downwardly causing the pivotable rod actively engaged therewith to move arcuately to engage the underside of the back flap 13 and lift the same upwardly and forwardly of the back end 7*a*, as shown in dotted lines in FIG. 2, all during the continued forward movement of the container 5 along the path 3 upon energization of the cylinder pivotable rod arrangement. This arrangement may be energized by selective air pressure sufficient to cause the pivotable rod 46 to reach its upper position 43 just at the time, and preferably before, the back end 7 reaches such longitudinal downstream point so as to lift the back flap 13 to the position above described in which its outer free edge 15 may be more properly engaged by the forewardly and downwardly inclined lower run of the belt 48 during continued forward movement of the container 5. The positive engagement of the pivotable rod 15 lifting the back flap 13 to its appropriate position prevents any such occurrence and, therefore, no crushing or bending out of shape may occur.

Generally, the back flap 13 should define an angle Ld (FIG. 4*c*), which is at most a right angle, and preferably a slightly acute angle, with the upstream portion of the lower run of the belt 48 at the point at which such upstream portion contacts the outer free edge 15, i.e. adjacent the upper position 43, as shown in FIG. 4*c*, to insure that as the back flap continues to move with the container 5 along the conveyor 4 the faster moving belt 48 will further decrease such angle between the back flap and upstream portion of the lower run to enable the back flap to be eventually acommodated in the stationary guides 54, as is clear form FIGS. 1 and 4*c*.

Due to the adjustable speed of movement of the pivotable rod 46 relative to that of the conveyor 4, and the adjustable mounting of the pusher 40 and of the back flap directing means 47, the desired pusher axis or line of movement of the rod 46 may be selectively varied to accommodate any appropriate size container 5 and to assure the attaining therewith of such proper right angle or acute angle alignment between the lower run of the belt 48 and the upwardly raised back flap 13.

To achieve effective and positive coordinated operation of the puller 18 and pusher 40, a control system is provided whereby to displace these parts concordantly and affirmatively from their lower positions to their upper positions, i.e. upon contact of the puller 18 with the front end 6 of the container 5. The control system includes container sensing means such as a first limit switch or main switch 66 provided with a resiliently displaceable container sensing probe 67, and a second limit switch or interrupt switch 68 provided with a similar resiliently displaceable probe 69.

Switches 66 and 68 are preferably disposed on a common bracket 70 via selectively movable arms 71 and 72, bracket 70 being selectively movably attached to the adjacent leg of the base section 33 and positioned on the opposite lateral side of the path 3 from that at which the pusher 40 is positioned, as shown in FIGS. 2 and 3.

Preferably, bracket 70 is vertically adjustably relative to the leg of the base section 33 on which it is attached, and arms 71 and 72 are independently horizontally adjustable both longitudinally and transversely relative to the path 3.

The first switch 66 is situated at a longitudinal point relative to path 3 a distance downstream from the longitudinal point at which the free end of the piston rod 46 is situated when the pusher 40 is at the lower position 41, such distance being roughly equal to the length of the particular container 5 being handled.

The second switch 68 is situated at a longitudinal point relative to path 3 a corresponding distance downstream from the longitudinal point at which the free end of the piston rod 46 is situated when the pusher is at the upper position 43, such distance likewise being roughly equal to the length of such container 5.

Thus, the second switch 68 is adjustably selectively located downstream from the first switch 66 relative to the path 3 travelled by the container back end 7 on the conveyor 4 from a point just slightly downstream of the pusher 40 during the time the free end of the piston rod 46 is moved from the lower position 41 to the upper position 43.

This concordant short distance, and thus the longitudinal points of the second switch 68 and of the upper position 43 and in turn the angle of the pusher axis or line of movement L of the pusher 40, will be selected in dependence upon the coordinated movement speeds of the conveyor 4 and pusher 40, or such speeds will be selected in dependence upon such short distance, as the artisan will appreciate.

Hence, when the front end 6 of the container 5 being handled reaches the probe 67 of the first switch 66, it displaces the probe resiliently forwardly at the same time as it exerts tension against the puller 18 and causes the latter to be forwardly displaced under the resilient force of the springs 26. Upon completion of the forward displacement of the probe 67, when it makes sliding contact with the container lateral side 9, as shown in FIG. 3, the switch 66, which is a normally open switch, closes a control circuit which energizes the actuation of the piston-cylinder arrangement 20 and also simultaneously the actuation of the piston-cylinder arrangement 44.

The puller 18 then moves to its upper position 24 and at roughly the same time the pusher 40 also moves to its upper position 43, whereby to achieve the folding of the frontand back flaps 12 and 13 as previously described.

In this regard, all during this time the conveyor 4 and belt 48 are continuously moving under the energizing force of the motor 31 and the motor 51, yet with the belt 48 travelling at a faster adjustable speed than that of the conveyor 4.

The motor 51 may be optionally conveniently used as well to energize a blower 73 located on the bridge section 29, as shown in FIGS. 1 and 2, to cool the motor.

Once the back flap 13 has been lifted by the pusher or lifter 40 into the moving path of the belt 48 and the back end 7 of the container 5 passes beyond the free end of the piston rod 46 in the upper position 43, the container front end 6 reaches the probe 69 of the second switch 68. The container 5 them displaces the probe 69 forwardly resiliently until the second switch 68, which is a normally closed switch, opens a subcircuit which deenergizes the actuation of the piston-pivotable rod arrangement 44, i.e. causes the pivotable rod 46 to move back into its downwardly extending position.

On the other hand, the control circuit is such that the puller 18 remains in its upper position 24 until the entire container 5 in question has moved beyond the upper position 24 and in turn the back end 7 has moved beyond the puller element 23. This condition is sensed by the first switch 66 since the first probe 67 returns the switch to its normally open position as soon as the probe loses contact with the container lateral side 9 and resiliently returns to its original position. At this point, the control circuit again opens to deenergize the actuation of the piston-cylinder arrangement 20 i.e. causes the piston rod 22 to move out from the cylinder 21 and the puller element 23 in turn to move from the upper position 24 back to the lower position 19, to await its next actuation in handling the front flap 12 of the next such oncoming container 5.

When the container 5 thereafter clears the second probe 69, the probe similarly resiliently returns to its original position and return the second switch 68 to its normally closed position, the circuit of course remaining deenergized since the first switch 66 has already reopened.

Thus, for instance, the first and second switches 66 and 68 may be operatively provided in control circuit 74 as shown in FIG. 5, which also contains a first solenoid SOL. 1 arranged for operating a valve V1 for pneumatically energizing the puller 21 to retract the piston rod 22 and a second solenoid SOL. 2 arranged for operating a valve V2 for pneumatically energizing the pusher cylinder 45 to extend the pivotable arm 46 and which circuit is electrically energized by a power source 75, such as a battery or any other appropriate energizing means.

By arranging the first solenoid SOL. 1 in a first subcircuit 74*a* in series with the normally open first switch 66, and the second solenoid SOL. 2 and normally closed second switch 68 in a second subcircuit 74*b* in series with the normally open first switch 66, but in parallel with the first solenoid SOL. 1, both solenoids are energized when the front end 6 of the container 5 causes the probe 67 of the first switch 66 to be displaced as earlier described for closing the circuit 74 by closing the normally open first switch 66.

These solenoids operate the valves V1 and V2 respectively for generally simultaneous energizing of both cylinders 21 and 45 with compressed air to retract the piston rod 22 and to extend the piston rod 46 and thus displace the puller 18 and pusher 40 to their concordant upper positions 24 and 43 as the container 5 continues its forward movement, as shown in FIGS. 4*a* to 4*d*.

When the front end 6 of the container 5 next causes the probe 69 of the second switch 68 to be displaced as earlier described, this opens the normally closed second switch 68. This deenergizes the second solenoid SOL. 2 in the now open second subcircuit 74*b*, i.e. while the still closed first subcircuit 74*a* continues to energize the first solenoid SOL. 1, for retracting the pusher piston rod 46 via the valve V2 and displacing the pusher 40 to its original lower position 41 after the corresponding back end 7 of the container 5, and thus the entire length of the container, has moved forwardly therepast.

In turn, when the back end 7 of the container 5 reaches the first switch 66 and the entire length of the container 5 has moved therepast, this releases the probe 67 from contact with the container and causes the probe to be displaced under its resilient force in return direction so as to reopen the normally open first switch 66. This deenergizes the first solenoid SOL. 1 in the now open first subcircuit 74*a*, i.e. while the second subcircuit 74*b* continues to remain open, for extending the puller piston rod 22 via the valve V1 and displacing the puller 18 to its original lower position 19 after the corresponding back end 7 of the container 5, and thus the entire length of the container, has moved forwardly therepast.

As is clear from the foregoing, the positioning of the first switch 66 and the range of resiliently displaceable or pivotal operation of its probe 67 relative to the particular container 5 and the dimensions or size of such container, will normally be selected in concordance with the angle of the piston-cylinder arrangement 20 and the respective longitudinal locations and intervening distance between the lower position 19 and the upper position 24 of the puller 18, and also with the speed of linear movement of the puller piston rod 22 during its respective extending and retracting displacement phases, i.e. for a given speed of linear movement of the conveyor 4, such that when the entire length of the container has moved completely past the first switch 66 and the cylinder 21 is deenergized via the first solenoid SOL. 1 and Valve V1, the interim response time will be sufficient for the back end 7 of the continuously moving container 5 to clear the puller element 23 in the upper position 24 before such puller element begins its downward and rearward movement to its original lower position 19, ready for handling the front flap of the next successive container.

Nevertheless, due to the desired longitudinally resilient mounting of the puller 18 via the springs 26 or the like, even if the puller element 23 is still downstream of the back end 7 of the container 5, e.g. in sliding contact with the flipped over underside surface of the back flap 13 after terminating its contact with the flipped over underside surface of the front flap 12 (compare FIGS. 1 and 4*d*), when the cylinder 21 is deenergized to extend the piston rod 22, the puller 18 will resiliently accommodate such obstruction and permit the puller element 23 to ride rearwardly on the flipped over underside surface of the back flap 13 under the extending force of the cylinder 21 simultaneously with the continuous forward movement of the container 5 along the path 3 until the puller element 23 clears the back end 7 and moves downwardly behind the container to the lower position 24.

Finally, when the back end 7 of the container 5 reaches the second switch 68 and the entire length of the container 5 has moved therepast, this releases the probe 69 from contact with the container and enables the probe to be displaced under its resilient force in return direction in unhindered and non-critical manner so as to reclose the normally closed second switch 68 and its subcircuit 74*b*. Hence, both the first subcircuit 74*a* and second subcircuit 74*b* are in fact open at this point since the probe 67 of the normally open first switch 66 is no longer controlled by or in contact with the container 5, and thus the control system is ready for handling the next successive container.

Naturally, any appropriate means may be provided for mounting the various conjointly and concordantly operating parts of the arrangement in selectively adjustable position, e.g. for independently adjustably positioning vertically, longitudinally, transversely and/or angularly, as the case may be, i.e. relative to the path 3 and the surface of the conveyor 4, not only each of the puller 18, the pusher 40 and the switches 66 and 68, but also the back flap directing means 47, whereby to accommodate containers of varying size or dimensions such as cases or boxes, e.g. filled with beverage cans or the like.

By providing the piston-cylinder arrangements 20 and 44 as double acting piston-cylinder arrangements, advantageously positive rapidly responsive displacement in each of the extending and retracting directions will be achieved for the piston rod 22 and the arm 46 in their respective movements to and from their upper positions, as the artisan will appreciate.

It will be realized, in this regard, that the solenoids SOL. 1 and SOL. 2 may be provided optionally, as shown in FIG. 5, as relay controlled solenoids of the conventional type for controlling the operation of the valves V1 and V2 in desired sequential manner, such that, firstly, when the front end 6 of the container 5 contacts the probe 67 of the first switch 66, both solenoids cause the valves to operate so as to move to a first valve position at which correspondingly the cylinder 21 is energized with compressed air or the like to retract the piston rod 21 and more or less at the same time the cylinder 45 is energized with compressed air or the like in similar manner but instead to extend the pivotable arm 46; secondly, when the front end 6 of the container 5 contacts the probe 69 of the second switch 68, the second solenoid SOL. 2 under the control of its relay R2 causes its valve V2 to operate so as to move to a second valve position at which correspondingly the cylinder 45 is reversely energized with such compressed air or the like to retract the piston rod 46*a* before the second subcircuit 74*b*, and in turn the second solenoid SOL. 2, is deenergized via the conjoint opening of the second switch 68; and thirdly, when the back end 7 of the container 5 releases the probe 67 of the first switch 66, the first solenoid SOL. 1 under the control of its relay R1 causes the valve V1 to operate so as to move to a second valve position at which in like manner correspondingly the cylinder 21 is reversely energized with such compressed air or the like to extend the piston rod 22 before the first subcircuit 74*a*, and in turn the first solenoid SOL. 1, is deenergized via the conjoint opening of the first switch 66.

Accordingly, such relay arrangement will assure positive rapidly responsive displacement of the piston rods 22 and 46 in each displacement direction under the energizing pressure of the compressed air or the like, due to the double acting nature of the piston-cylinder arrangements 20 and 44.

In any case, as is clear from the foregoing, the subsequent release of the probe 69 when the back end 7 of the container 5 moves therebeyond will merely cause the second switch 68 to move to its normally closed position without affecting the circuit operation since at this point the first switch 66, which is in series with the second switch 68, is in normally open position.

Alternatively, the control circuit may be otherwise arranged for appropriate concordant operation of the piston-cylinder arrangements 20 and 44 in conjunction with the switches 66 and 68, as the artisan will appreciate.

Thus, the cylinder 21 may be arranged as a conventional single acting piston retracting cylinder and the piston rod 22 may be operatively provided with a return spring (not shown) so that upon the release of the probe 67 when the back end 7 of the container 5 moves therepast, the cylinder 21 is pneumatically deenergized, i.e. no longer supplied with energizing compressed air or the like, due to the associated electric deenergizing of the first solenoid SOL. 1 by the opening of the first switch 66, and the piston rod 22 is forced by the return spring to be displaced to extended position as the compressed air or the like is exhausted from the corresponding pressure side of the cylinder 21.

In like manner, the cylinder 45 may be arranged as a conventional single acting piston extending cylinder and the piston rod 46 may be operatively provided with a return spring (not shown) so that upon the engaging of the probe 69 when the front end 6 of the container moves into contact therewith, the cylinder 45 is pneumatically deenergized, i.e. no longer supplied with energizing compressed air or the like, due to the associated electric deenergizing of the second solenoid SOL. 2 by the opening of the second switch 68, and the piston rod 46*a* is forced by the return spring to be displaced to retracted position as the compressed air or the like is exhausted from the corresponding pressure side of the cylinder 45.

Such return spring alternative arrangement will achieve analogous positive rapidly responsive displacement of the piston rod 22 and pivotable arm 46 in moving to their upper positions under the energizing pressure of the compressed air or the like and in moving to their lower positions under the stored force of their respective return springs, being aided by gravity during the return phase of movement thereof correspondingly to their lower positions.

Moreover, due to the opposed orientation of the piston-cylinder and piston-pivotable rod arrangements 20 and 44, advantage of gravity may be taken even without the use of such return springs. Thus, the piston rod 22 may be displaced to the upper retracted position 24 by supplying energizing compressed air or the like to the cylinder 21 throughout the time the first switch 66 remains closed to control such energizing, e.g. via the electric energizing of the first solenoid SOL. 1 for controlling the opening of the first valve V1 to pressure feed position. Then, upon the opening of the first switch 66, when the back end 7 of the container 5 moves therepast, so as to discontinue the supplying of energizing compressed air or the like to the cylinder 21, e.g. by corresponding discontinuing of the electric energizing of the first solenoid SOL. 1 for controlling the closing of the first valve V1 to pressure exhaust position, the piston rod 22 may be displaced to the lower extended position 19 by dint of its mere deadweight under gravity without the need for any such return spring.

In like manner, the pivotable rod 46 may be displaced to the upper extended position 43 by supplying energizing compressed air or the like to the cylinder 45 throughout the time both the first switch 66 and the second switch 68 remain closed to control such energizing, e.g. via the electric energizing of the second solenoid SOL. 2 for controlling the opening of the second valve V1 to pressure feed position. Then, upon the opening of the second switch 68, when the front end 6 of the container 5 moves therepast, so as to discontinue the supplying of energizing compressed air or the like to the cylinder 45, e.g. by corresponding discontinuing of the electric energizing of the second solenoid SOL. 2 for controlling the closing of the second valve V2 to pressure exhaust position, the pivotable rod 46 may be displaced to the downward extending position 41 likewise by dint of its mere dead weight under gravity without the need for any such return spring.

It will be appreciated in this regard that the angular attitude of both piston rods 22 and 46*a* will be selected such that they respectively define an acute angle with the vertical which is sufficiently small enough to assure such gravity return to lower position, as may be seen from the angular disposition of these two rods relative to the vertical as shown in FIG. 4*c*. Of course, in this gravity return instance, the return movement of the rods 22 and 46 corresponding to their lower positions will be relatively slower than by compressed air or return springs force energized positive actuation return movement.

Nevertheless, since the rods 22 and 46 correspondingly only move from their temporary upper positions 24 and 43 to their normal lower positions 19 and 41 after the entire length of the particular container 5 has moved forwardly past each in turn, the time required for gravity return thereof is not particularly critical.

This is especially true since the upstream pivotable rod 46 is controlled by the second switch 68, to permit timely gravity return as soon as the back end 7 of the container 5 has moved forwardly therepast and long before such back end 7 has moved past the first switch 66, and in turn adequately before the next successive container 5 reaches the piston rod 46. Similarly, since the downstream piston rod 22 is located a distance downstream from the rod 46 roughly equal to the entire length of a given container 5, and since the piston rod 22 is controlled by the first switch 66, its timely gravity return will be achieved in this instance also, since such return will begin as soon as the back end 7 of the container 5 being handled has moved forwardly past the piston rod 22, and thus correspondingly adequately before the next successive container 5 reaches the piston rod 22.

However, to assure unhindered and trouble-free operation in this gravity return instance, a greater longitudinal interval or distance between successive containers 5 along the path 3 than otherwise may have to be provided.

Optionally, adequate predetermined selective longitudinal spacing between successive containers 5 travelling on the conveyor 4 may be attained in conventional manner, e.g. by providing on the surface of the conveyor 4 a pair of transverse spacer bars in transversely aligned yet laterally spaced relation to each other (not shown), at longitudinally spaced apart successive intervals along the surface of the conveyor 4 sufficiently to accommodate a given container 5 between an upstream pair of such transversely aligned bars conveyingly abutting its back end 7 and a downstream pair of such transversely aligned bars adequately spaced forwardly of its front end 6, such that the downstream pair of bars serve for conveyingly abutting the back end 7 of the next preceding container at a distance avoiding jamming of the containers against each other, and move significantly at a distance at least slightly greater than the common length of the front and back flaps being folded where the front flap 12 is temporarily attached or affixed to the front end 6 of the container, and otherwise at a distance at least slightly greater than twice such common length, to avoid obstruction of the operation and especially of the puller 18 and pusher 40 and the front and back flaps of the container then being handled by the excessively close proximity of the next adjacent container.

Of course, the bars of each said transversely aligned pair should be laterally spaced apart sufficiently to provide a central clearance gap transversely therebetween for the puller element 23 when the puller 18 is in lower position to avoid any possible snagging or obstruction of the puller element 23 by such pairs of bars as they move with the surface of the conveyor 4 along the path 3.

Since the piston rod 22 does not return to its normal lower position 19 until the entire length of the container 5 being handled thereby has moved forwardly therepast, and since both piston rods 46 and 22 are next displaced to their respective upper positions 43 and 24 only when the next successive container 5 reaches the first switch 66, generally the longitudinal distance between the successive containers 5 need safely be only slightly greater than the combined individual lengths of the back flap of the preceding container and the front flap of the following container when both flaps are freely or loosely disposed, or only slightly greater than the length of the back flap when the front flap is affixed to the front end of the container to conserve space, so long as such distance is sufficient to permit unhindered raising and folding of the normally equal length front and back flaps of each successive container by the puller 18 and pusher 40 and unhindered return of the puller and pusher to their normal lower positions for engagement of the next set of front and back flaps in the manner earlier described.

Rapid rate cycle operation is assured in any event because the rods 46 and 22 may be displaced at rapid displacement speed in each direction when of the double acting type in conjunction with the operation of the conveyor 4 at a correspondingly rapid speed, such that the next successive container 5 will reach the pusher 40 just after it returns to its lower position and in turn reach the puller 18 just after it returns to its lower position.

Hence, in the ultimate instance where the front flap 12 is so affixed to the front end 6 of each container 5 to conserve space between the containers, the longitudinal interval between successive containers 5 need only be slightly greater than the linear composite distance comprising the flipping radius or length of the front flap 12 plus the longitudinal operative extent of the puller element 23 and sufficiently to enable the piston rod 22 to move downwardly behind the previously handled (or first) container, be contacted by the next (or second) container and pry loose and flip over its affixed front flap 12 without hindrance from the previously handled (or first) container (see FIG. 4*c*). At the same time, the pusher 40 will safely raise the back flap 13 of that same next (or second) container without hindrance since the front flap of the next following (or third) container is also affixed to its front end and rearwardly spaced from that same next (or second) container a like said linear composite distance.

Of course, if the back flap 13 is longer than the front flap 12, as where these flaps of the container are of unequal length, then the distance between the successive containers should also be slightly greater than the length of the back flap, as the artisan will appreciate.

Alternatively, a reciprocatable gate 76, e.g. controlled by a double acting gate piston-cylinder arrangement 77 of similar construction and operation to piston-cylinder arrangements 20 and 44 may be optionally provided in conventional manner adjacent the conveyor 4 and crosswise of the path 3, as shown in phantom in FIG. 3, for movement of the gate 76 into the path 3 ahead of the next successive container 5 to restrain such container temporarily against continued forward movement, e.g. while the container remains in sliding frictional contact with the continuously moving surface of the conveyor 4.

The operation of such gate 76 is conventional and may be manually or automatically actuated, as desired. It will only be needed where the above mentioned optional pairs of transverse spacer bars (not shown) are omitted.

The gate 76 may even be controlled in an optional auxiliary subcircuit 74*c* of the control circuit 74, which contains a third relay R3 and a third solenoid SOL. 3 for controlling a third valve V3 for the piston-cylinder arrangement 77, e.g. in a manner similar to the operation of the first subcircuit 74*a*, as shown in phantom in FIG. 5.

In this case, the first switch 66 will be provided as a conventional compound switch, not only for operation of the first relay R1 to control the first solenoid SOL. 1 and in turn the first valve V1 in the subcircuit 74*a*, but also for operation of the third relay R3 to control the third solenoid SOL. 3 and in turn the third valve V3 in the subcircuit 74*c* which is in parallel with each of subcircuits 74*a* and 74*b*.

Hence, the third subscircuit 74*c* will operate more or less simultaneously with the first subcircuit 74*a*, to move the gate 76 into the path 3 when the front end 6 of the container being handled by the puller 18 and pusher 40 contacts the probe 67 and closes the first switch 66 to displace the puller 18 and pusher 40 to their upper positions.

The gate 76 will thus restrain the next successive container should it be too close to the next preceding container being handled by the puller 18 and pusher 40 at that point, and will only retract from the path 3 when the back end 7 of such container being handled releases the probe 67 and opens the first switch 66. However, this arrangement will maintain an interval exceeding or at best roughly equalling one complete container length between successive containers, due to the manner in which switch 66 operates.

Of course, the gate 76 may be arranged for operation otherwise as the artisan will appreciate, and may even be used as a fail-safe means to restrain forward movement of successive containers under appropriate manual or automatic sensing control, should there be a disruption in the normal handling of a given container by the puller 18 and pusher 40 for any reason.

It should be noted that the puller element 23 when at the upper position 24 may be temporarily disposed in the transverse space between the parallel guides 54 and in close proximity to the relatively thin plate thickness free end front flap plate extension portions 56 thereof as the front flap 12 is folded over thereby across the top portion 11 of the container 5.

Due to the clear dead space between the upper surface of each flat plate extension portion 56 and the underside of the bridge section 29, as shown in FIGS. 1 and 2, the flipped over front flap 12 will slidingly contact, along its lateral side portions, the upper surface of each such flat plate extension portion 56 can be held securely in position by a pressure foot 56*a* which is operated by cylinder 56*b* then pressure plate 56*a* provides a positive holding down of the front flap as it emerges.

Of course, by appropriate adjustment of the positioning of the first switch 66 and the puller 18 in relation to the flat plate extension portions 56, and of the relative speeds of movement of the conveyor 4 and upward displacement of the puller 18, the operation may be carried out such that when the puller element 23 reaches the upper position 19 and flips over the front flap 12, the outer free edge 14 thereof will clear the forwardly facing free ends of such extension portions 56, so as to avoid any such sliding contact.

Thus, whereas the speed of movement of the pusher 40 will generally exceed that of the conveyor 4, that of the puller 18 need not necessarily exceed that of the conveyor 4 and may even be slower than that of the conveyor 4 so as to assure that the outer free edge 14 of the flipped over front flap 12 is forwardly beyond the forwardly facing free ends of such extension portion 56 at the point at which the front flap 12 is flipped over by the puller 18, i.e. depending on the longitudinal spacing of the successive containers.

In this regard, a conventional central guide (not shown) may be optionally provided just downstream of the range of amplitude of movement of the puller 18, and move specifically of the piston-cylinder arrangement 20 about the pivot pin 27, and at roughly the same height as the flat plate extension portions 56 for maintaining the front and back flaps 12 and 13 in favorably folded condition across the top portion 11, as where the side flaps 16 and 17, e.g. after having adhesive material applied to their outwardly exposed surfaces, are next upwardly folded inwardly over the front and back flaps 12 and 13 to complete the closure of the container 5 in the conventional manner.

Thus, the various elements of the apparatus 1 according to the present invention may all be arranged in and on a simple and relatively short or longitudinally compact framework or path support 2, including a base section 33 having supporting legs and a bridge section 29, formed as a generally inverted U-shaped longitudinally compact unitary composite structure which may accommodate therewithin the conveyor 4. Thus, the longitudinally compact unitary composite structure of the apparatus 1 of the present invention may advantageously constitute a self-contained portable flap folder unit which may be arranged as a temporary or permanent add-on assembly to an existing conveyor installation along a corresponding relatively short span there-along without the need to modify the existing installation since such unit is self-contained and need only be supplied with energizing power to operate motor 51 to run the belt 48 and the control circuit. Air pressure from a standard source is used for operation of the cylinder.

Such self-contained flap folder unit may therefore be operated in more or less independent manner. Hence, in review, as a container 5 enters the self-contained unit, it first comes in contact with the front flap puller element 23, which is attached to the free end of the piston rod 22 which is displaceable within the double acting air cylinder 21. Then the puller element 23 is held against the container front end 6 by the springs 26 connected operatively to the cylinder 21. Once tension is made against the container, the first limit switch 66 is contacted which activates the piston rod 22 through the first solenoid SOL. 1, its control valve V1 and the energizing of the cylinder 21, whereby to move the piston rod upwardly. The upwardly moving piston rod 22 pulls the puller element 23 and in turn the front flap 12 upwardly along therewith, e.g. breaking the optionally provided temporary tab T which locks the front flap down against the container front end 6. Simultaneously, this switch 66 also activates the piston rod 46 through the second solenoid SOL. 2, and its control valve V2 and the energizing of the double acting air cylinder 45 within which the piston rod 46*a* is displaceable, whereby to move the piston rod upwardly. The upwardly moving piston rod 22 flips the front flap 12 over when it reaches the upper position 24, and the upwardly moving pivotable arm 46 flips the back flap 13 upwardly and when it reaches the upper position 43, it flips the back flap into contact with the ribbed belt 48 which is moving forwardly along its lower run in the same direction as the container 5 on the conveyor 4 but at a faster rate. This best 48 in conjunction with the stationary guides 54 forces the back flap 13 forwardly and down onto the top portion 11 of the container 5. Next, the container 5 contacts the second switch 68, which operatively deactivates the cylinder 45 so as to return its pivotable rod 46 to its downwardly extending normal position 41. Lastly, the first switch 66 controls the activation of the cylinder 21 to hold its piston rod 22 at its upper position 24 until the container 5 releases the first switch 66, which operatively deactivates the cylinder 21 so as to return its piston rod 22 and the puller element 23 to the lower normal position 19.

This series of steps and functions, of course, all occur at a relatively rapid rate on the fly while the container 5 is travelling at any appropriate conveyor speed, i.e. continuously along the conveyor 4.

Accordingly, the control system includes the first limit switch 66 positioned so that when the container 5 contacts it, the switch activates both solenoids SOL. 1 and SOL. 2, and in turn the first solenoid SOL. 1 controls the double acting air cylinder 21 while the second solenoid SOL. 2 simultaneously controls the double acting cylinder 45. It also includes the second limit switch 68 positioned downstream of the first switch 66 so that when the container 5 contacts the second switch, such second switch deactivates the cylinder 45, returning its rod 46 to its normal position, whereas the first switch 66 controls the cylinder 21 to hold its piston rod 22 in its upper position until the entire length of the container 5 has passed and then deactivates the cylinder 21 to return its piston rod 22 to its normal position, whereupon the cycle may be repeated with the next successive container at relatively rapid rate and essentially trouble-free coordinated step automatic operation within a comparatively short or longitudinally compact portion of the conveyor path, e.g. roughly corresponding to the length of the container being handled, and in an adjustable manner so as to accommodate different size containers with ease.

Of course, as the artisan will appreciate, the cylinder arrangement 44, composed of the cylinder 45 and rod 46, may be modified in several ways. For example, as shown in the alternative arrangement of FIG. 6. In this case, the composite two piece telescoping arm or stabilizer 63 is instead provided as a duplicate double acting piston-cylinder arrangement 44$^1$ to arrangment 44, with a like ball and socket connector 64$^1$ for mounting its support end on the angle bracket 60 in the vicinity of the pivot pin 61, and with a clamp collar 65$^1$ freely slidably arranged on the exterior of the front end of its cylinder 45$^1$. Also, the clamp collar 65 is omitted from the cylinder 45, the free end of the piston rod 46 is articulatedly pivotally connected to the slidable clamp collar 65$^1$, and the free end of the piston rod 46$^1$ serves as the pusher probe.

Suitably, both such piston-cylinder arrangements 44 and 44$^1$ may be flow connected in parallel with the second valve V2 for common simultaneous compressed air energized double acting positive displacement operation.

As a result, when the cylinders 45 and 45$^1$ are energized to extend their piston rods 46 and 46$^1$, the piston rod 46 of the piston-cylinder arrangement 44, as it moves outwardly from its cylinder 45 and upwardly pivots the piston-cylinder arrangement 44 about the ball and socket connector 64 as pivot point, will in turn displace the piston-cylinder arrangement 44$^1$ in upward angular direction about the ball and socket connector 64$^1$ as pivot point at the same time as the piston rod 46$^1$ moves outwardly from its cylinder 45$^1$.

This will cause the piston rod 46$^1$ as pusher to move in a path which will assure upward contact thereof with the underside of the back flap 13 thereat a well as positive forward urging of the back flap 13 into contact with the overlying lower run of the faster moving ribbed belt 48 at a point at which the back flap 13 is forwardly bended or folded above the top portion 11 of the container 5 and its outer free edge 15 is located forwardly of the container back end 7, sufficiently for the back flap 13 to be at an angle to the lower run of the belt 48 which is at most a right angle and preferably an acute angle as earlier described.

By reason of such dual piston rod displacement conjointly and simultaneously, the free end of the piston rod 46$^1$ will attain an upper position which is transversely closer to the angle bracket 60 than that in the unmodified arrangement shown in FIG. 3, e.g. at about the centerline of the path 3 or even closer to such bracket 60, as compared to the remote upper position 43 which is located transversely beyond the centerline of the path 3 and adjacent the opposite lateral side of the path 3 from that at which the bracket 60 is situated. This is because the piston-cylinder arrangement 44$^1$ pivots upwardly and forwardly about the ball and socket connector 64$^1$ simultaneously with the outward movement of the piston rod 46$^1$ and the forward movement of the container 5.

Such attainment of the upper position in this alternative instance will occur at an earlier point in the travel of the container 5 relative to the belt 48 than that in the unmodified arrangement shown in FIG. 3, since the upper position is transversely closer to the bracket 60 and thus the pusher will force the back flap 13 forwardly of the back end 7 of the container 5 at a corresponding earlier point and/or will force such flap farther forwardly of such back end 7 for insuring the above described proper angular contact of the back flap 13 with the lower run of the belt 48.

The present structure also provides a sensing shoe 56*a* which in effect acts as a safety device to sense whether any bottle is protruding above the case surface. In this event, such protruding bottle could jam in the machine itself and the sensing device 56*b* would, when engaged by the protruding bottle or any portion thereof, become activated to cause the machine's operation to come to a halt.

It will be realized that the foregoing specification is set forth by way of illustration and not limitation, and that various modifications and changes may be made therein without departing from the spirit and scope of the present invention which is to be limited solely by the scope of the appended claims.

What is claimed is:

1. Container flap folding apparatus comprising means defining a longitudinal conveyor path arranged for accommodating a conveyor for moving along the path in a forward direction closable flap containers of the type having relative to such path a transverse front end and a transverse back end as well as a bottom portion and a top portion and provided at the top portion with outwardly and downwardly prefolded corresponding transverse front and back end flaps terminating at outer free edges located when at maximum outward and downward position at a corresponding intermediate level between the top portion and bottom portion, such that the end flaps are arranged to be upwardly and inwardly folded across the top portion, a front flap puller normally positioned in the path at a lower position for contact with the front end of such a container below the maximum outward and downward position of the outer free edge of the outwardly and downwardly folded front flap thereof during the forward movement of the container, and being displaceable upwardly and forwardly to an upper position above yet adjacent the top portion of the container for pulling the front flap upwardly and for relatively urging the upwardly pulled front flap rearwardly to fold the flap inwardly and downwardly across the top portion during the continued forward movement of the container, a back flap lifter selectively upstream of the puller along the path and normally positioned out of the path, and being moveable into the path, and both upwardly from below the maximum outward and downward position of the outer free edge of the outwardly and d downwardly folded back flap of the container into raising contact with such flap and relatively forwardly of the back end of the container, to an upper position above yet adjacent the top portion of the container for lifting the back flap upwardly and forwardly for locating the outer free edge thereof relatively at least slightly forwardly of the back end of the container during the continued forward movement of the container, back flap directing means cooperating with the lifter and arranged adjacent the upper position of the lifter for forwardly directing the upwardly and forwardly pushed back flap inwardly and downwardly to fold the flap across the top portion of the container during the continued forward movement of the container, and a control system for correspondingly displacing the puller and lifter from their lower positions to their upper positions upon contact of the puller with the container.

2. Apparatus of claim 1 wherein the control system includes container sensing means for maintaining the puller in its upper position until the back end of the container has moved therepast.

3. Apparatus of claim 1 wherein a conveyor is arranged for moving the containers along the path, and the back flap directing means include a forwardly downwardly inclined endless moving belt arranged for engaging the back flap in the forward direction along the path at a moving speed exceeding that of the conveyor for further pushing the back flap inwardly and downwardly across the top portion, and stationary pressing guide means for receiving the further inwardly and downwardly pushed back flap and guidingly pressing such flap across the top portion of the container during the continued forward movement of the container.

4. Apparatus of claim 1 wherein the puller and lifter are each displaced between their lower and upper positions by a corresponding piston-cylinder arrangement.

5. Apparatus of claim 1 wherein the puller is provided with a prying edge sufficient for engaging the outer free edge of the front flap of the container when the front flap is temporarily attached to the front end of the container, for prying loose such front flap therefrom upon displacement of the puller to its upper position.

6. Apparatus of claim 1 wherein the control system includes a control circuit having a normally open first limit switch arranged in the path longitudinally adjacent the puller lower position for continuous contact with the corresponding container throughout its movement therepast for closing such switch for controlling the displacing of the puller and lifter to their respective upper positions and for controlling the maintaining of the puller in its upper position until the entire container has moved therepast and the first switch reopens for in turn controlling the displacing of the puller back to its lower position, and also having a normal closed second limit switch arranged in the path downstream of the first switch a selective distance sufficient for the meanwhile displacing by the first switch of the lifter to its upper position before the container reaches the second switch, the second switch being arranged for contact with the container for opening such second switch for controlling the displacing of the lifter back to its downwardly extended position before the entire container has moved past the first switch.

7. Apparatus of claim 6 wherein the puller and lifter are each displaced between their lower and upper positions by a corresponding piston-cylinder and piston-pivotable rod arrangement, and the control circuit includes a puller solenoid controlled by the first switch for operating the piston-cylinder arrangement for the puller during the entire time the container is in contact with the first switch, and also includes a lifter solenoid initially controlled by the first switch for operating the piston-pivotable rod arrangement for the lifter upon contact of the container with the first switch and thereafter controlled by the second switch upon contact of the container therewith, and during the time the container is still in contact with the first switch, for subsequently operating the piston-cylinder arrangement for the pusher.

8. Apparatus of claim 1 wherein the puller is longitudinally resiliently mounted relative to the path for resilient travel a selective distance in the forward direction upon contact with the front end of the container and during the continued forward movement thereof when the puller is in its lower position for enhancing the contact between the puller and the container and for return travel a corresponding distance in the rearward direction upon displacement of the puller to its upper position for enhancing the uring of the front flap rearwardly during the folding of the flap inwardly and downwardly across the top portion of the container.

9. Apparatus of claim 1 wherein a conveyor is arranged for moving the containers along the path, and the conveyor is disposed for continuously moving the containers along the path at a selective substantially constant speed.

10. Method of folding container flaps comprising moving automatically along a longitudinal path in forward direction successive spaced apart closable flap containers of the type having relative to such path a transverse front end and a transverse back end as well as a bottom portion and a top portion and provided at the top portion with outwardly and downwardly prefolded corresponding transverse front and back end flaps terminating at outer free edges located at a corresponding intermediate level between the top portion and bottom portion, such that the end flaps are arranged to be upwardly and inwardly folded across the top portion, maintaining a front flap puller normally positioned in the path at a lower position for contact with the front end of an oncoming such container below the outer free edge of the outwardly and downwardly folded front flap thereof during the forward movement of the container, and upon such contact automatically displacing the puller upwardly and forwardly to an upper position above yet adjacent the top portion of the container for pulling the front flap upwardly and for relatively urging the upwardly pulled front flap rearwardly to fold the flap inwardly and downwardly across the top portion during the continued forward movement of the container, maintaining a back flap lifter selectively upstream of the puller along the path and normally positioned out of the path at a lower position, and at substantially about the same time that the container contacts the puller also automatically moving the lifter into the path, and both upwardly from below the outer free edge of the outwardly and downwardly folded back flap of the container into raising contact with such flap and relatively forwardly of the back end of the container, to an upper position above yet adjacent the top portion of the container for lifting the back flap upwardly and forwardly for locating the outer free edge thereof during the continued forward movement of the container, and thereafter returning the pusher to its lower position, automatically forwardly directing the upwardly and forwardly lifted back flap inwardly and downwardly to fold the flap-across the top portion during the continued forward movement of the container, and automatically maintaining the puller in its upper position until the entire container moves therepast, and thereafter returning the puller to its lower position for contact with the front end of the next oncoming such container.

11. Method of claim 10 wherein the containers are continuously moved automatically along the path at a selective substantially constant speed.

12. Method of claim 10 wherein the front flap of the corresponding such container is temporarily attached to the front end thereof, and the puller is provided with a prying edge sufficient for engaging the outer free edge of the front flap for prying loose such front flap therefrom upon displacement of the puller to its upper position, and such displacement is automatically carried out to effect such prying loose of the front flap.

* * * * *